US008869960B2

(12) United States Patent
Mangano

(10) Patent No.: US 8,869,960 B2
(45) Date of Patent: Oct. 28, 2014

(54) EXPANDABLE MULTI-COMPARTMENT LUGGAGE

(75) Inventor: Joy Mangano, St. James, NY (US)

(73) Assignee: Ingenious Designs LLC, Ronkonkoma, NY (US)

( * ) Notice: Subject to any disclaimer, the term of this patent is extended or adjusted under 35 U.S.C. 154(b) by 126 days.

(21) Appl. No.: 13/555,682

(22) Filed: Jul. 23, 2012

(65) Prior Publication Data

US 2013/0020160 A1 Jan. 24, 2013

Related U.S. Application Data

(60) Provisional application No. 61/510,858, filed on Jul. 22, 2011.

(51) Int. Cl.
*A45C 5/14* (2006.01)
*A45C 7/00* (2006.01)

(52) U.S. Cl.
CPC ..... *A45C 5/14* (2013.01); *A45C 7/0068* (2013.01); *A45C 7/0086* (2013.01)
USPC ..... 190/18 A; 190/18 R; 190/107; 190/108; 190/109; 190/110; 111/112; 111/113; 111/114; 111/115; 280/47.34; 280/638; 280/639; 280/47.131; 280/654; D3/303

(58) Field of Classification Search
USPC ..... 190/18 R, 18 A, 107–115; 280/47.34, 280/638, 639, 47.131, 654
See application file for complete search history.

(56) References Cited

U.S. PATENT DOCUMENTS

| | | | | |
|---|---|---|---|---|
| 3,061,057 | A | 10/1962 | Miller | |
| 3,319,744 | A | 5/1967 | Smith | |
| 3,606,372 | A | 9/1971 | Browning | |
| 4,081,061 | A | 3/1978 | Tucker | |
| 4,361,215 | A * | 11/1982 | Sawai | 190/18 A |
| 4,420,068 | A | 12/1983 | Gerch | |
| 5,099,968 | A | 3/1992 | Kikuchi | |
| 5,103,945 | A * | 4/1992 | Kaneko | 190/107 |
| 5,186,290 | A | 2/1993 | Takayama | |
| 5,209,279 | A | 5/1993 | Wilson | |
| 5,265,894 | A | 11/1993 | Dunn | |
| 5,413,199 | A | 5/1995 | Clement | |
| 5,522,487 | A | 6/1996 | Nordstrom | |
| 5,547,052 | A | 8/1996 | Latshaw | |
| 5,575,391 | A | 11/1996 | Gerch | |
| 5,609,278 | A | 3/1997 | Fresco | |
| D398,149 | S | 9/1998 | Sanderson et al. | |
| 5,810,064 | A | 9/1998 | Sanderson et al. | |

(Continued)

*Primary Examiner* — Fenn Mathew
*Assistant Examiner* — Cynthia Collado
(74) *Attorney, Agent, or Firm* — Galgano & Associates, PLLC; Thomas M. Galgano; Jessica G. Bower

(57) ABSTRACT

An expandable multi-compartment luggage having a second luggage bag hingeably attached to the first luggage bag. The second luggage bag having an upper portion and a collapsible lower portion. The collapsible lower portion being moveable between a collapsed position to an expanded position defining a lower interior compartment. The luggage also including a dividing wall disposed between the upper and lower portions of the second luggage bag, and which is movable from a closed position dividing the upper interior compartment of the second luggage bag and the lower interior compartment of the second luggage bag and an open position with the upper interior compartment of the second luggage bag being in communication with the lower interior compartment of the second luggage bag.

9 Claims, 11 Drawing Sheets

(56) References Cited

U.S. PATENT DOCUMENTS

| | | | | |
|---|---|---|---|---|
| 5,896,962 | A | 4/1999 | Smith et al. | |
| 6,073,737 | A | 6/2000 | Kang | |
| 6,135,253 | A | 10/2000 | Weissman et al. | |
| 6,213,267 | B1 | 4/2001 | Miller | |
| 6,382,377 | B2 | 5/2002 | Godshaw | |
| 6,494,352 | B1 | 12/2002 | Mullen | |
| 6,502,676 | B2 | 1/2003 | Dexheimer | |
| 6,520,327 | B1 | 2/2003 | Boardman et al. | |
| 6,637,633 | B1 | 10/2003 | Eberle | |
| D483,940 | S * | 12/2003 | Dolan | D3/217 |
| 7,140,479 | B2 | 11/2006 | Mangano et al. | |
| D543,021 | S * | 5/2007 | Lee et al. | D3/217 |
| 7,232,018 | B1 | 6/2007 | Salander | |
| 7,322,477 | B2 | 1/2008 | Schweitz | |
| D582,673 | S | 12/2008 | Mangano | |
| 7,503,569 | B2 * | 3/2009 | Duvigneau | 280/47.18 |
| 7,588,146 | B1 | 9/2009 | Salander et al. | |
| 7,779,975 | B2 | 8/2010 | Boraas | |
| 7,779,976 | B2 | 8/2010 | Mangano | |
| 7,900,757 | B2 | 3/2011 | Sisitsky | |
| 7,909,150 | B2 | 3/2011 | Mangano | |
| 7,938,412 | B2 * | 5/2011 | Katz | 280/47.34 |
| 2002/0125669 | A1 | 9/2002 | Chang | |
| 2002/0153216 | A1 | 10/2002 | Krulik | |
| 2004/0108179 | A1 * | 6/2004 | Scicluna et al. | 190/109 |
| 2006/0260893 | A1 | 11/2006 | Drew et al. | |
| 2007/0068757 | A1 | 3/2007 | Tan | |
| 2008/0223677 | A1 | 9/2008 | Mauro | |
| 2008/0302623 | A1 | 12/2008 | Gupton, Jr. | |
| 2009/0139814 | A1 | 6/2009 | Grossman et al. | |

* cited by examiner

EXPANDABLE MULTI-COMPARTMENT LUGGAGE

CROSS-REFERENCE TO RELATED APPLICATION

This application claims benefit from U.S. Provisional Patent Application No. 61/510,858, filed Jul. 22, 2011, the contents of which are hereby incorporated by reference.

BACKGROUND OF THE INVENTION

1. Field of the Invention

The invention is generally in the field of luggage. More particularly, the invention relates to multi-compartment luggage which is expandable and collapsible and reconfigurable.

2. Brief Description of the Prior Art

Luggage is often times used by travelers and others in order to transport clothing and other items, such as, toiletries and souvenirs between locations. The available storage space within a luggage bag is normally constrained by its design limitations and the construction of the bag. Thus, travelers often times have multiple pieces or a set of luggage to suit their various needs, such as, for example, a smaller duffle for a weekend trip or a larger rolling suitcase for a longer vacation. However, it is desirable to have a single article of luggage which is expandable and collapsible to allow the user to change the interior volume and which is versatile and reconfigurable depending on the user's needs.

In addition, travelers have long sought out ways to maximize the amount of space in their luggage to allow for the packing of as many items as possible. Often times, a traveler will return home from a trip with more items than they departed with, having purchased souvenirs during their travels and left to figure out a way of transporting these new items because their luggage is already packed to capacity. It is, therefore, useful to have an article of luggage with greater versatility which is capable of expanding and collapsing and is reconfigurable.

While the prior art discloses many types of luggage, so far as is known, none of the prior art devices afford this versatility in a simple, effective and yet highly advantageous manner as does the present invention.

SUMMARY OF THE INVENTION

It is therefore an object of the invention to provide a novel article of luggage.

It is also an object of the invention to provide an article of luggage with greater versatility and which is reconfigurable.

It is another object of the invention to provide an article of luggage with multiple compartments.

It is a further object of the invention to provide an article of luggage which is capable of expanding and collapsing.

It is yet another object of the invention to provide an article of luggage wherein two luggage compartment can be combined into a larger single compartment.

It is also an object of the invention to provide an article of luggage which is simpler and less expensive to manufacture than the prior art luggage.

Certain of the foregoing and related objects are readily attained according to the present invention by the provision of an expandable multi-compartment luggage, comprising a first luggage bag having four sidewalls, and a closed bottom which define a first interior compartment therebetween; a second luggage bag hingeably attached to said first luggage bag and moveable between a first closed position whereby said second luggage bag is connected to said first luggage bag to restrict access to said interior compartment of said first luggage bag, and a second open position to provide access to said interior compartment of said first luggage bag, wherein said second luggage bag has an upper portion and a collapsible lower portion, said lower portion having a closed bottom and four lower sidewalls, each having an upper edge collectively defining an upper rim and said upper portion having four generally upstanding upper sidewalls defining an upper interior compartment therebetween, each of said upper sidewalls having a lower edge collectively defining a lower rim which is releasably coupleable to a portion of said upper rim of said lower portion, wherein said upper portion has an upper rim defining an openable top, and wherein said collapsible lower portion is moveable between a collapsed position to an expanded position defining a lower interior compartment between said closed bottom and four lower sidewalls of said lower portion; and a dividing wall disposed between said upper and lower portions of said second luggage bag, said dividing wall being movable from a closed position dividing said upper interior compartment of said second luggage bag and said lower interior compartment of said second luggage bag and an open position wherein said upper interior compartment of said second luggage bag is in communication with said lower interior compartment of said second luggage bag.

Preferably, the luggage further comprises a first zipper, wherein said four sidewalls of said first luggage bag each have a top edge and said second luggage bag is hingeably attached to said top edge of one of said sidewalls of said first luggage bag and said first zipper extends around said top edges of said other three sidewalls of said first luggage bag. It is also preferred that the luggage further comprise a plurality of wheels and a handle attached to said first luggage bag.

Desirably, the luggage further comprises four generally rigid foldable walls which have a size which generally corresponds to the size of said four lower sidewalls of said second luggage bag and wherein said four lower sidewalls each have a lower edge and said foldable walls are each connected to one of said four lower sidewalls generally adjacent to said lower edge and are moveable from a flat position wherein said foldable walls overlie said closed bottom of said lower portion and a generally upright position wherein said foldable walls each overlie one of said lower sidewalls. Advantageously, each of said foldable walls has a hook and loop fastener and each of said lower sidewalls of said second luggage bag has a corresponding hook and loop faster, each of which releasably engages with one of said hook and loop fasteners on said foldable walls, to maintain said foldable walls in said upright position.

Preferably, the dividing wall has a flap disposed therein and a zipper extending around a portion of the periphery of said flap. It is also preferred that a second zipper extends around said lower portion of said second luggage bag for maintaining said lower portion in said collapsed position.

In the preferred embodiment, a third zipper which extends around said upper edge of three of said lower sidewalls of said lower portion of said second luggage bag and a pair of handles, each coupled to an opposite sidewall of said upper portion of said second luggage bag.

BRIEF DESCRIPTION OF THE DRAWINGS

Other objects and features of the present invention will become apparent from the detailed description considered in connection with the accompanying drawings, which disclose several embodiments of the invention. It is to be understood that the drawings are to be used for the purpose of illustration only and not as a definition of the limits of the invention.

DETAILED DESCRIPTION OF THE PREFERRED EMBODIMENTS

Figure 1:
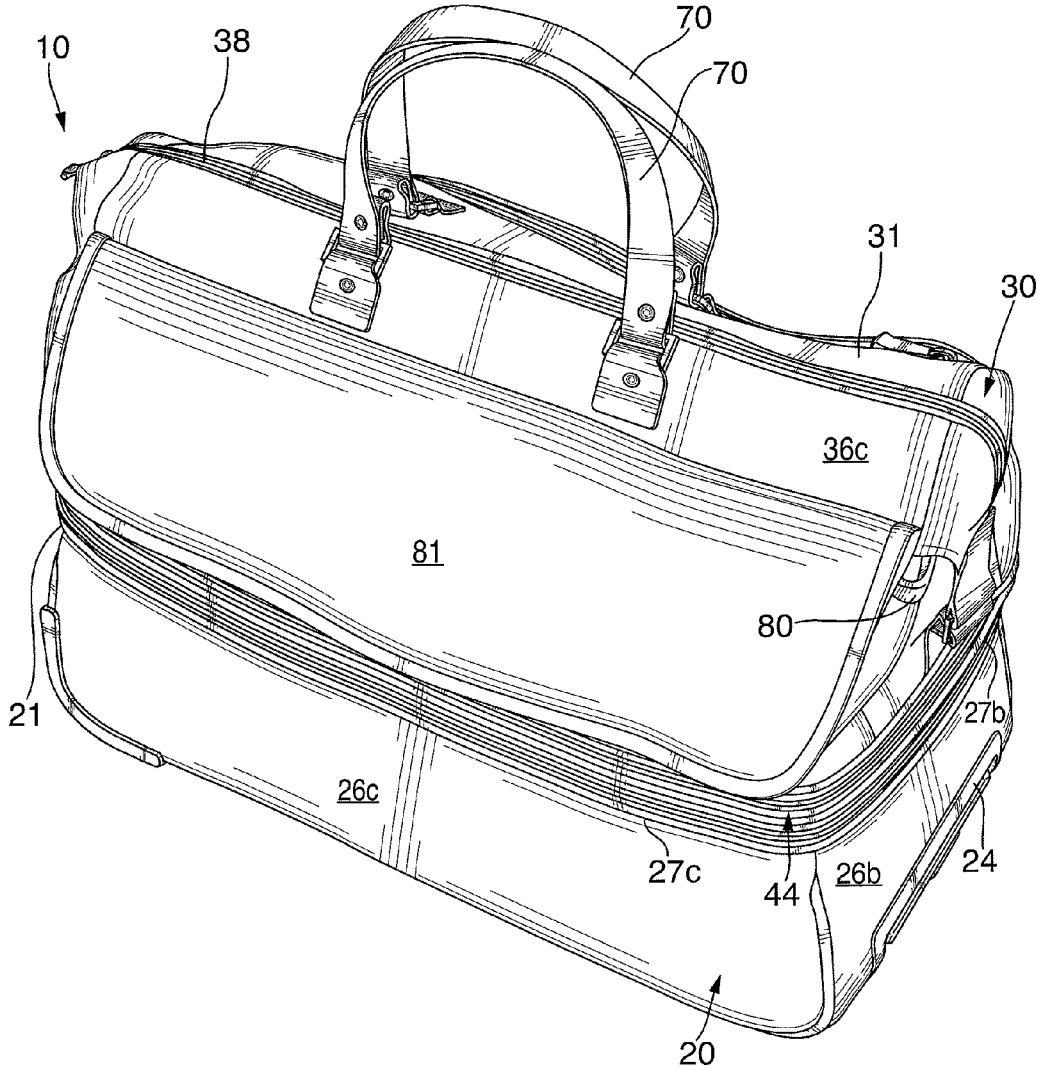
FIG. 1 is a front and right side perspective view of the luggage, according to the present invention, shown in its collapsed position.
Figure 2:
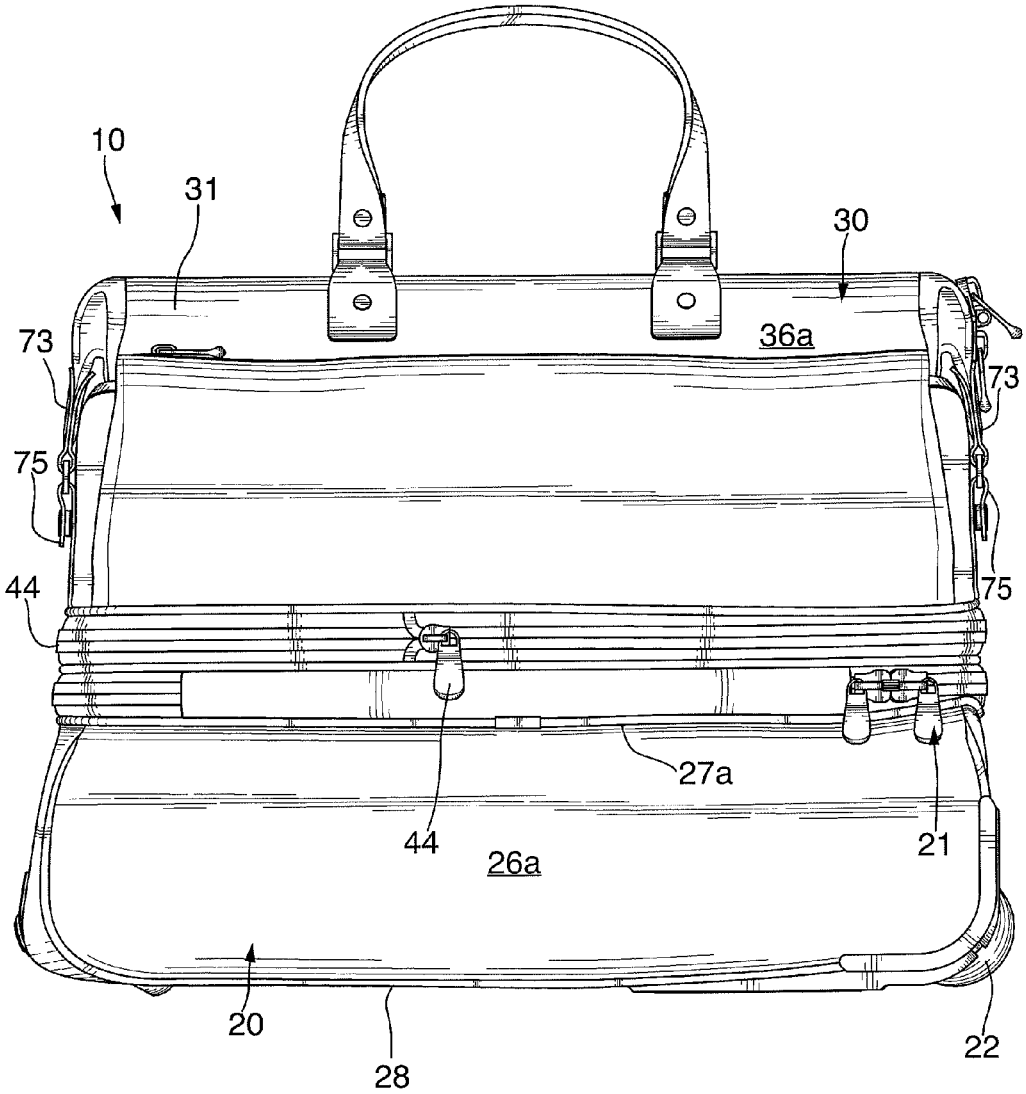
FIG. 2 is a rear elevational view thereof.

Turning now in detail to the drawings, and in particular FIGS. 1-7, which depict the expandable multi-compartment luggage, according to the present invention, generally designated by reference numeral 10. Luggage 10 comprises a first luggage bag or rolling suitcase, generally designated by reference numeral 20, and an attached, expandable and collapsible second luggage bag or duffle, generally designated by reference numeral 30 (shown in FIGS. 1-7 in its collapsed position).

Figure 7:
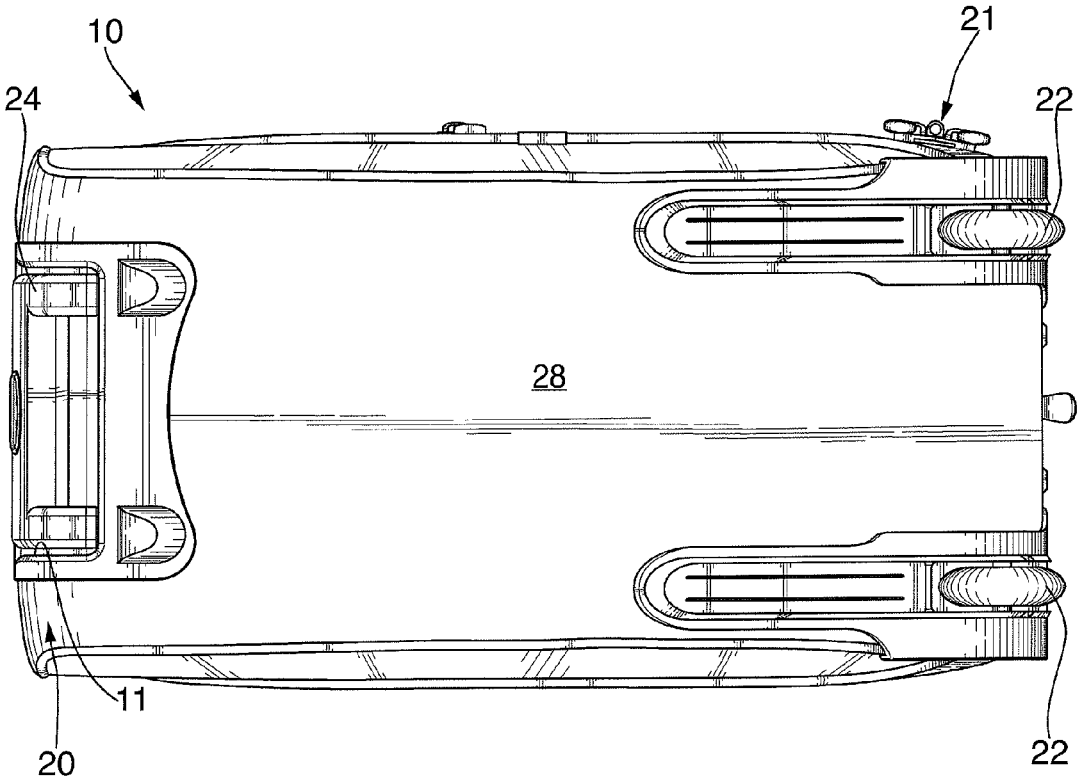
FIG. 7 is a bottom plan view thereof.

As shown best in FIG. 7, first luggage bag 20 has two conventional wheels 22 disposed on one end thereof and a conventional, extendable and retractable handle 24 disposed on the opposite end thereof. Handle 24 is moveable from a first, stored position in which it is disposed within a handle housing 11 formed in first luggage bag 20, as seen best in FIGS. 4 and 7, to a second, extended position wherein it is extended outwardly from handle housing 11 (not shown). Luggage 10 is capable of being tilted to a generally upright position and rolled along wheels 22 via the extended handle 24. In addition, as seen in FIGS. 1-8, first luggage bag 20 has four generally rigid sidewalls 26*a*-26*d*, and a generally rigid closed bottom 28 which define a first interior compartment 23 therebetween, for storage of various items therein such as clothing, shoes, toiletries, etc.

Figure 8:
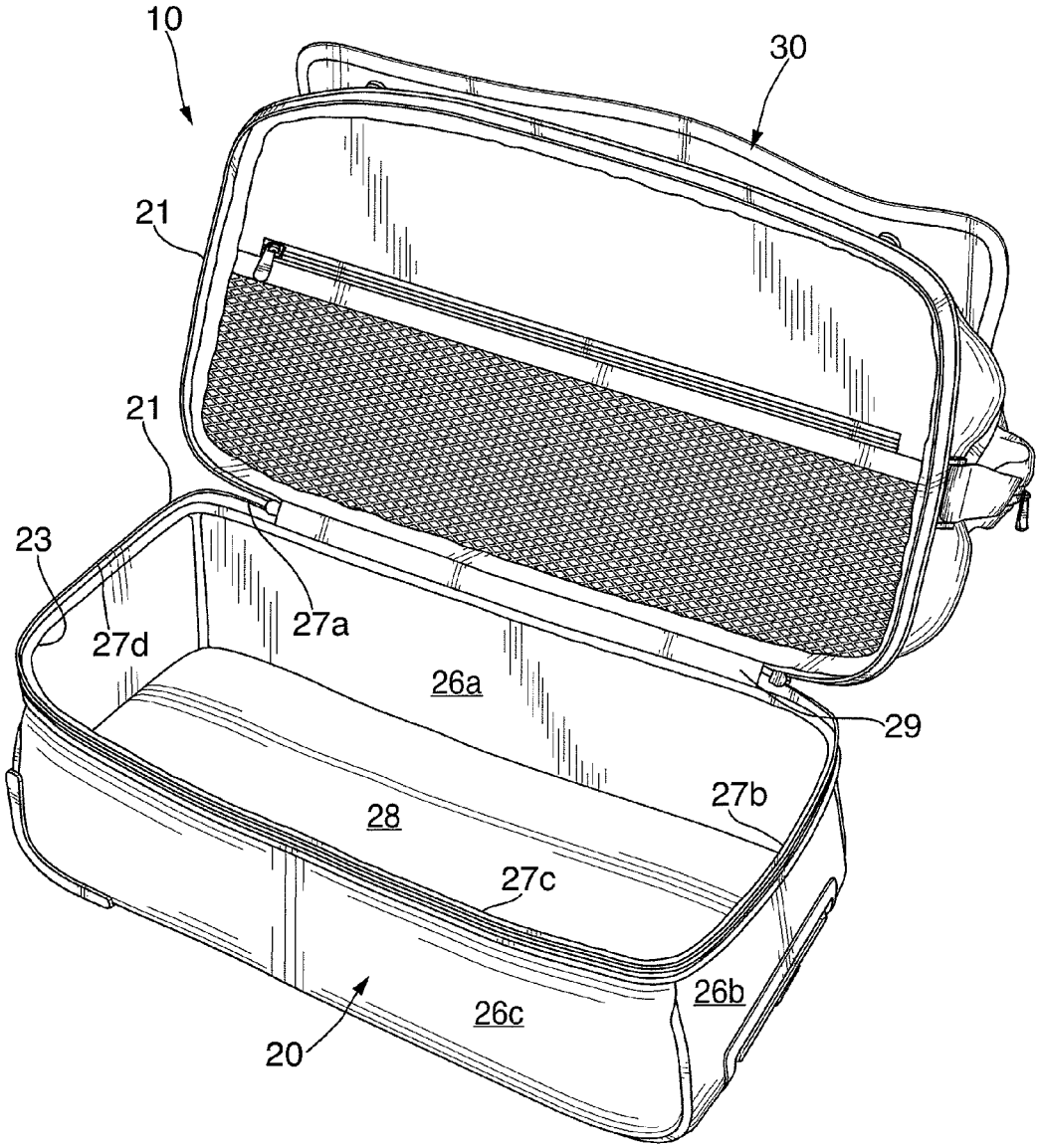
FIG. 8 is a perspective view of the luggage, in its non-expanded, open position.

As seen in FIG. 8, second luggage bag 30 is hingeably connected to first luggage bag 20, preferably via hinge 29, in order to maintain a connection between first luggage bag 20 and second luggage bag 30. Particularly, the four sidewalls 26*a*-26*d* of first luggage bag 20 each have a top edge 27*a*-27*d*, respectively. Second luggage bag 30 is attached via hinge 29 to at least a portion of top edge 27*a* of sidewall 26*a*. Zipper 21 is comprised of two conventional zipper tracks, one of which wraps around the top edges 27*b*-*d* of sidewalls 26*b*-26*d*, respectively, and a portion of top edge 27*a* of sidewall 26*a*, and the other of which extends along a corresponding portion on the bottom of second luggage bag 30, in order to releasably attach first luggage bag 20 to second luggage bag 30.

The hinge 29 allows second luggage bag 30 to be hingeably moveable between an open position, as seen in FIG. 8, to a closed position, as seen in FIGS. 1-7. In the closed position in FIGS. 1-7 and 9-11, second luggage bag 30 is connected to first luggage bag 20 via zipper 21 and hinge 29, in order to close bag 20 and restrict access to interior compartment 23. In the open position in FIG. 8, zipper 21 is released to provide access to the interior compartment 23 of first luggage bag 20. The second luggage bag 30 can be folded back via hinge 29 to reveal interior compartment 23, so that desired items can be placed therein. Zipper 21 can then be zipped to close bag 20, to assume the closed configuration in FIGS. 1-7 and 9-11.

Figure 9:
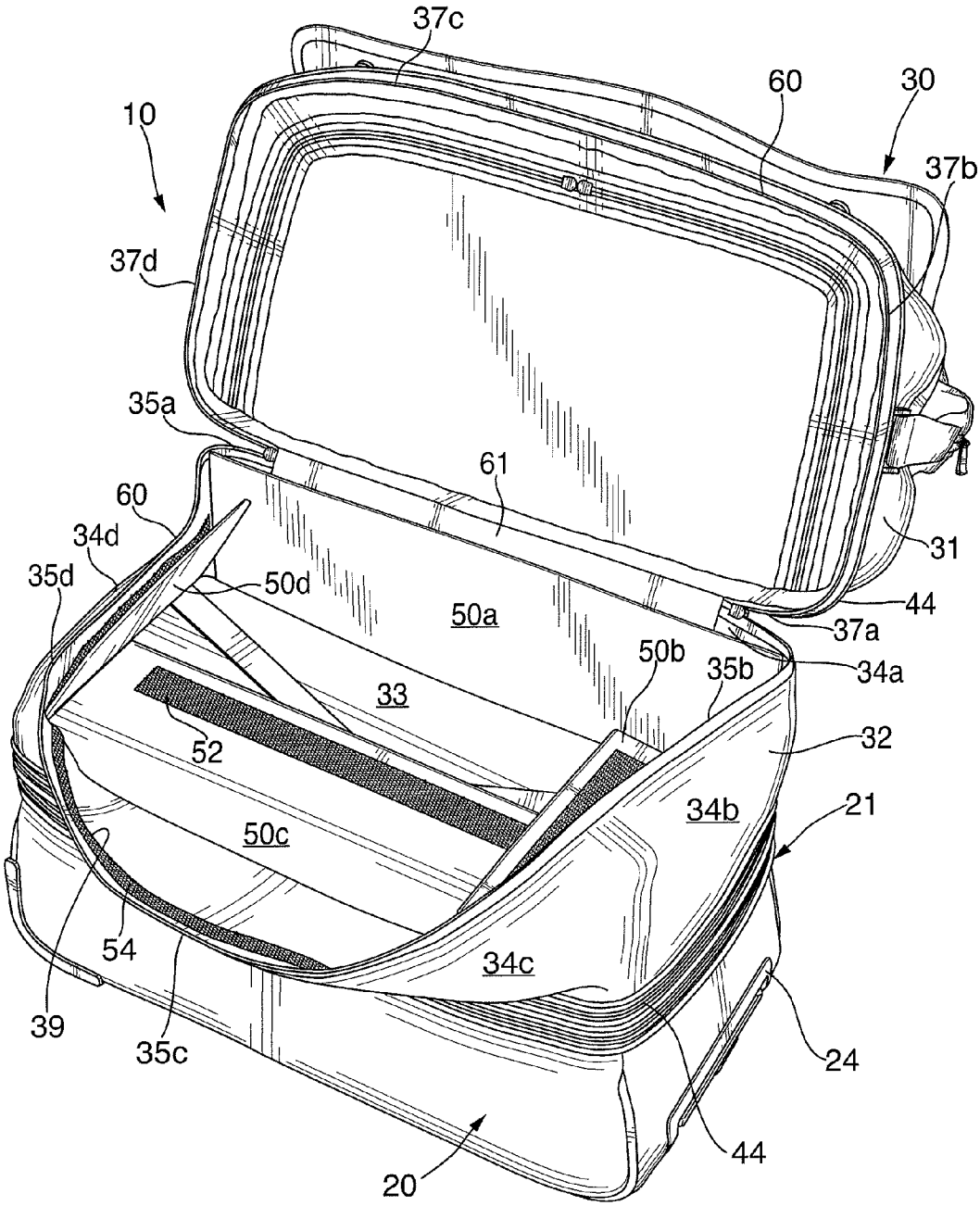
FIG. 9 is a perspective view of the luggage, in its expanded position, with the lower portion of the second luggage bag open and the foldable walls being moved between their folded position and their upright position.
Figure 10:
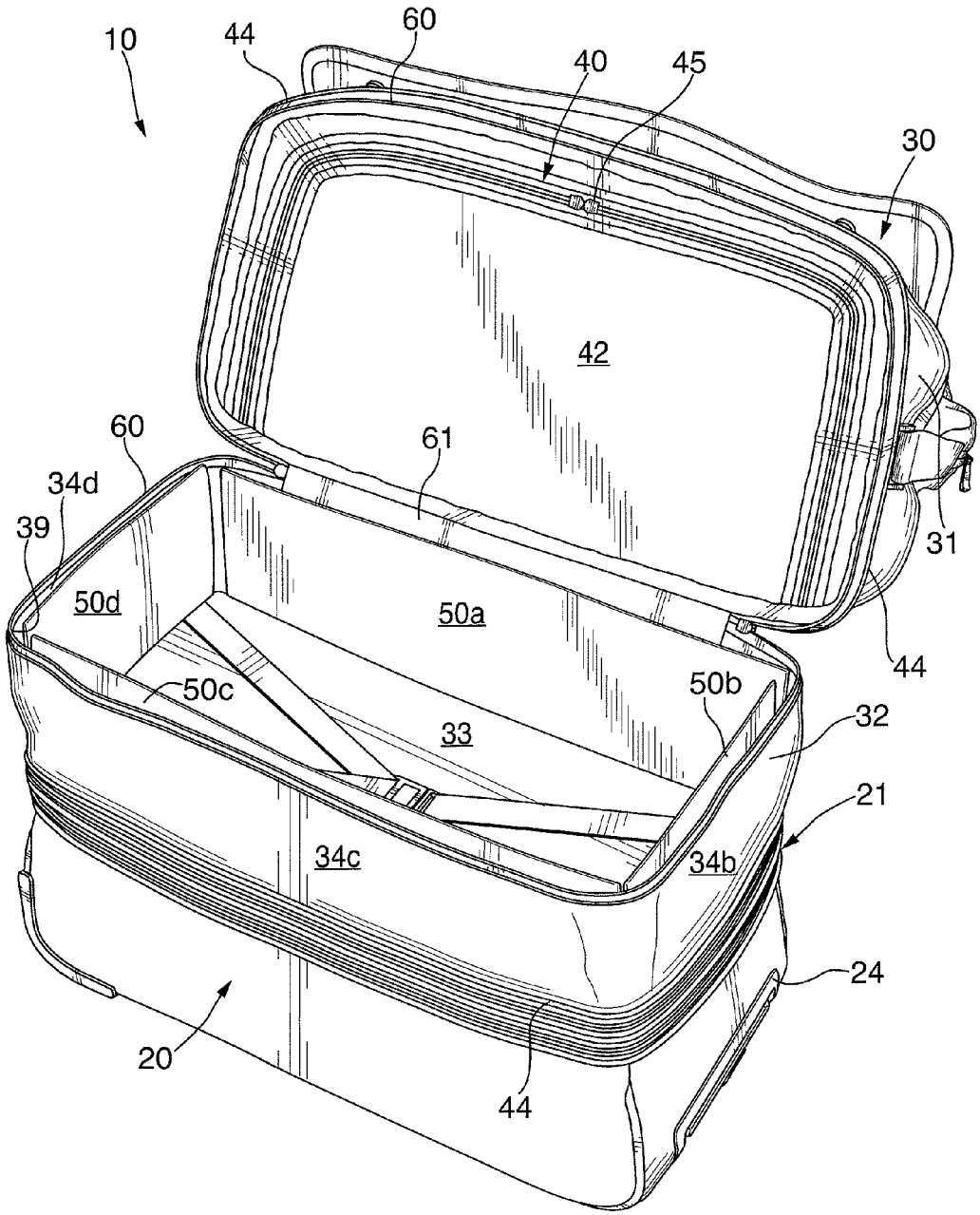
FIG. 10 is a perspective view of the luggage, similar to FIG. 9, but with all of the folded walls in their upright positions.
Figure 11:
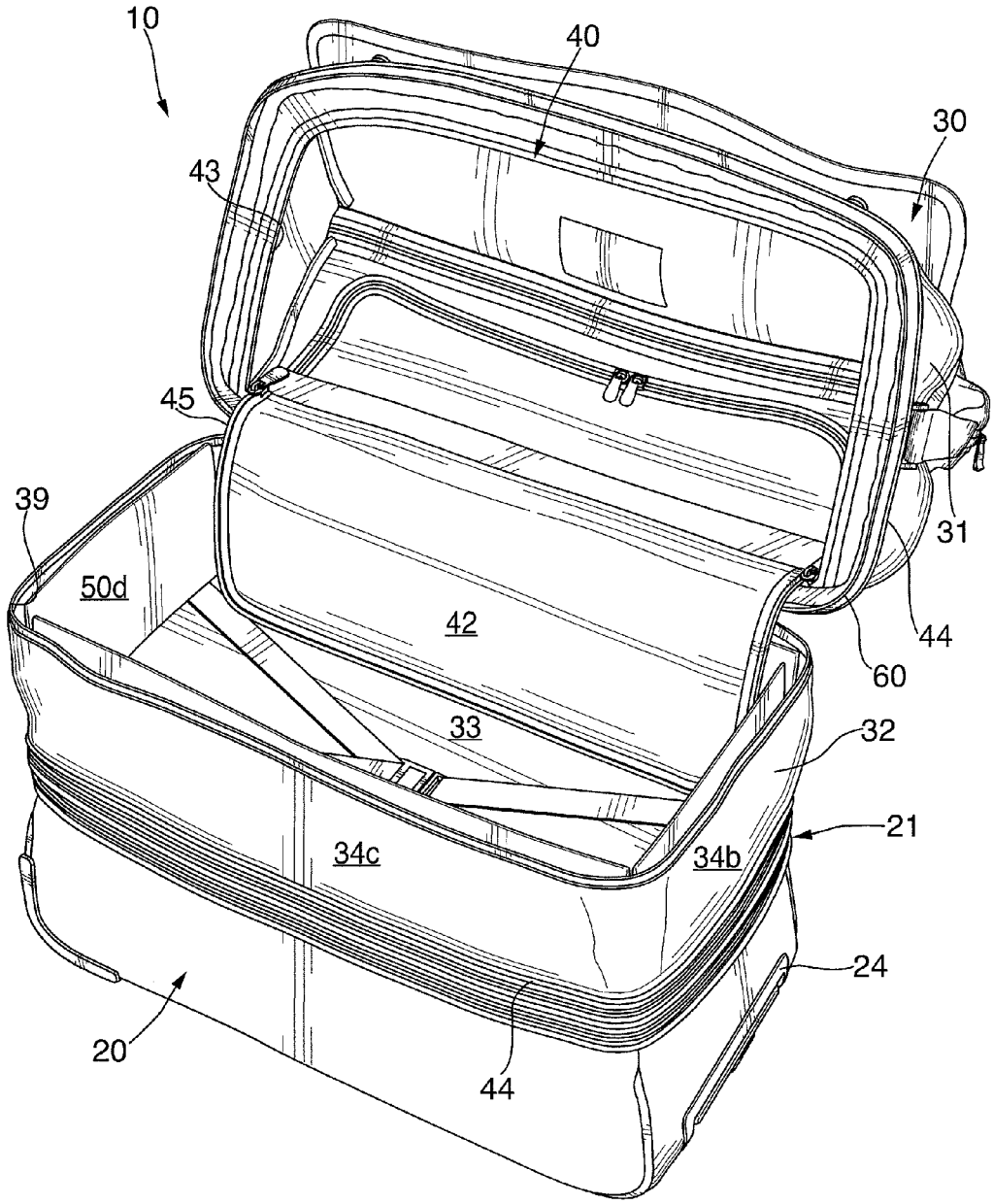
FIG. 11 is a perspective view of the luggage, similar to FIG. 9, with the dividing wall disposed between the upper and lower portions of the second luggage bag unzipped and folded downwardly.

Second luggage bag 30 can also be used to store items therein and is movable between a first, non-expanded configuration, as seen in FIGS. 1-8 and a second, expanded configuration, as seen in FIGS. 9-11, to provide for a smaller or larger interior volume, respectively, as is desired. Particularly, second luggage bag 30 has an upper portion 31 and an expandable and collapsible lower portion 32. As will be described more fully below, second luggage bag 30 is also reconfigurable to allow the interior luggage compartments of the upper and lower portions 31 and 32, respectively, to be either two separate compartments or joined together into a single larger compartment.

In the non-expanded or collapsed configuration in FIGS. 1-8, two separate interior luggage compartments are provided, namely, one within first luggage bag 20 and a second within upper portion 31 of second luggage bag 30. In the expanded configuration, a first luggage compartment is provided within first luggage bag 20, a second luggage compartment is provided within lower portion 32 of second luggage bag 30, and a third luggage compartment is provided within upper portion 31 of second luggage bag 30. As mentioned previously, the interior luggage compartments within the upper portion 31 and lower portion 32 of second luggage bag 30 can be joined together or separated.

As seen in FIG. 9, lower portion 32 has a closed bottom 33 and four flexible lower sidewalls 34*a*-34*d*. Each of sidewalls 34*a*-34*d* have an upper edge 35*a*-35*d*, respectively, which collectively define an upper rim. In addition, lower sidewalls 34*a*-34*d* are made of a flexible material to allow them to collapse and, in turn, fold upon themselves, when in the non-expanded or collapsed position.

As seen best in FIGS. 1-7, upper portion 31 has four generally upstanding but generally flexible upper sidewalls 36*a*-36*d* defining a duffle bag-like configuration having an upper interior compartment 43 therebetween. As shown in FIG. 9, each of upper sidewalls 36*a*-36*d* have a lower edge 37*a*-37*d*, respectively, collectively defining a lower rim which is releasably coupleable to at least a portion of the upper rim of lower portion 32 via a zipper 60 and hinge 61, as described more fully below. In addition, as shown in FIGS. 1-7 upper portion 31 has an upper rim with a zipper 38 defining an openable top, to provide access to interior compartment 43, to allow items to be placed and stored therein.

The collapsible and expandable lower portion 32 is moveable between a collapsed position, as seen in FIGS. 1-7, to an expanded position, as seen in FIGS. 9-11. In the expanded configuration in FIGS. 9-11, a lower interior compartment 39 is defined between closed bottom 33 and four lower sidewalls 34*a*-34*d* to provide an additional interior compartment which is otherwise concealed in the collapsed position. Interior compartment 39 is separate from interior compartment 23 of first luggage bag 20, but is versatile and reconfigurable and optionally, separate from interior compartment 43 of upper portion 31 (FIGS. 9-10) or in communication with interior compartment 43 of upper portion 31 (FIG. 11). In the collapsed position, because of their flexible nature, lower sidewalls 34*a*-34*d* collapse downwardly and fold upon themselves to overlie closed bottom 33.

As seen in FIGS. 1-7, in order to maintain second luggage bag 30 in its collapsed position, a zipper 44 is provided. Zipper 44 is a conventional zipper having two tracks, one of which extends around the lower periphery of lower portion 32 of second luggage bag 30, generally adjacent to zipper 21, and the other of which extends around a corresponding portion of lower edges 37*a*-37*d* of upper portion 31. The lower sidewalls 34*a*-34*d* fold upon themselves and can be positioned to overlie bottom 33, and disposed inwardly of zipper 44. Zipper 44 extends around and outwardly of the four sidewalls 34*a*-34*d* when collapsed and can be zipped to conceal sidewalls 34*a*-34*d* between the zipper 44, thus joining upper portion 31 adjacent to first luggage bag 20, as seen in FIGS. 1-7.

When in the expanded position, zipper 44 is unzipped to expose lower portion 32, zipper 60 and hinge 61. Hinge 61 is disposed along at least a portion of top edge 35*a* of lower portion 32, so that lower portion 32 is hingeably connected to upper portion 31. Hinge 61 allows lower portion 32 to be moveable from an open position as seen in FIGS. 9-11 to a closed position (not shown). Zipper 60 has two conventional zipper tracks, one of which extends around the upper edges 35*b*-35*d* of lower sidewalls 34*b*-34*d* and a portion of upper edge 35*a* of sidewall 34*a* and the other of which extends around a corresponding portion of the lower edges 37*a*-37*d* of upper portion 31, but disposed inwardly of zipper 44. Zipper 60 can be unzipped to allow access to interior compartment 39 of lower portion 32. Upper portion 31 can be folded back via hinge 61 to expose lower interior compartment 39. Zipper 60 can be zipped in order to close lower portion 32 of second luggage bag 30, to restrict access to interior compartment 39.

Additionally, as seen in FIGS. 9-10 in order to provide rigidity to the flexible sidewalls 34*a*-34*d* of lower portion 32 and, in turn, maintain the expanded configuration, four generally rigid pivotable or foldable walls 50*a*-50*d* are provided. Walls 50*a*-50*d* have a size which generally corresponds to the size of four lower sidewalls 34*a*-34*d*, respectively. Lower sidewalls 34*a*-34*d* each have a lower edge and the lower edge of foldable walls 50 are each connected to the lower edges of one of four lower sidewalls 34*a*-34*d*, to permit the foldable walls 50 to pivot approximately 90 degrees from a generally horizontal position to a generally vertical position. Particularly, each of foldable walls 50*a*-50*d* are moveable from a flat position, such as wall 50*c* in FIG. 9, where foldable walls 50*a*-50*d* overlie closed bottom 33 of lower portion 32 and a generally upright position, such as wall 50*a* in FIG. 10. Particularly, foldable walls 50*a*-*d* are pivoted upright to each overlie a corresponding lower sidewall 34*a*-34*d*, to provide a generally rigid lower portion 32.

Preferably, each of foldable walls 50 have a hook and loop fastener 52 and each of lower sidewalls 34*a*-34*d* has a corresponding hook and loop fastener 54. Each of the hook and loop fasteners 52 on the foldable walls 50 releasably engages with one of the hook and loop fasteners 54 on the corresponding sidewall 34*a*-34*d*, in order to maintain foldable walls 50 in their upright position to provide rigidity to lower sidewalls 34*a*-34*d*, and in turn, lower portion 32 of second luggage bag 30.

In addition, as seen in FIGS. 9-11, second luggage bag 30 includes a releasable dividing wall 40 which is disposed between upper portion 31 and lower portion 32, to permit interior compartments 39 and 43 to be separate or joined together. When second luggage bag 30 is in the expanded configuration, dividing wall 40 is movable from a closed position, as seen in FIGS. 9 and 10, to an open position, as seen in FIG. 11. In the closed position, dividing wall 40 divides upper interior compartment 43 from lower interior compartment 39, to provide two separate luggage compartments within second luggage bag 30. In the open position, upper interior compartment 43 is in communication with lower interior compartment 39, to provide for a single larger luggage compartment within second luggage bag 30. Preferably, dividing wall 40 has a flap 42 disposed therein and a zipper 45 extending around a portion of the periphery of flap 42, here three sides thereof. As seen in FIG. 11, zipper 45 can be unzipped to permit flap 42 to fold to, in turn, join interior compartments 39 and 43 together. As seen in FIGS. 9-10, zipper 45 can be zipped to separate interior compartments 39 and 43.

Figure 3:
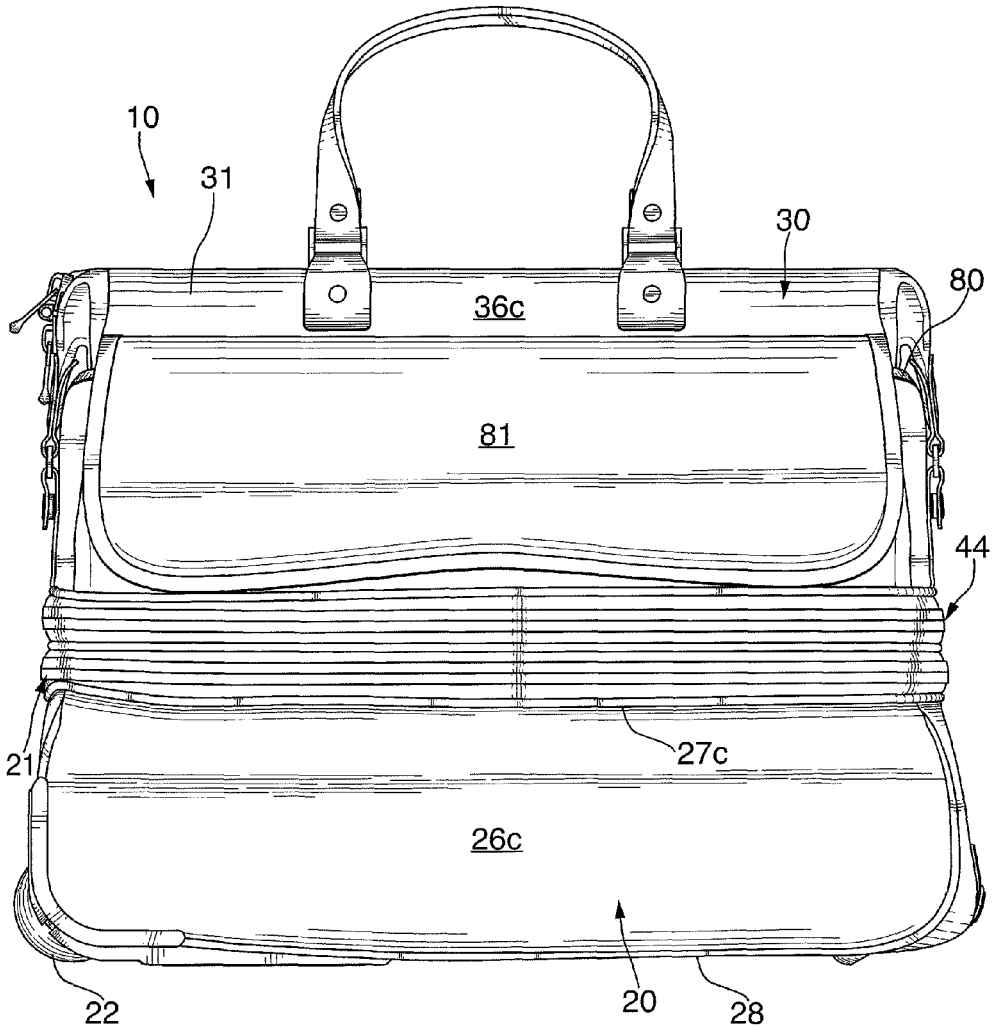
FIG. 3 is a front elevational view thereof.
Figure 4:
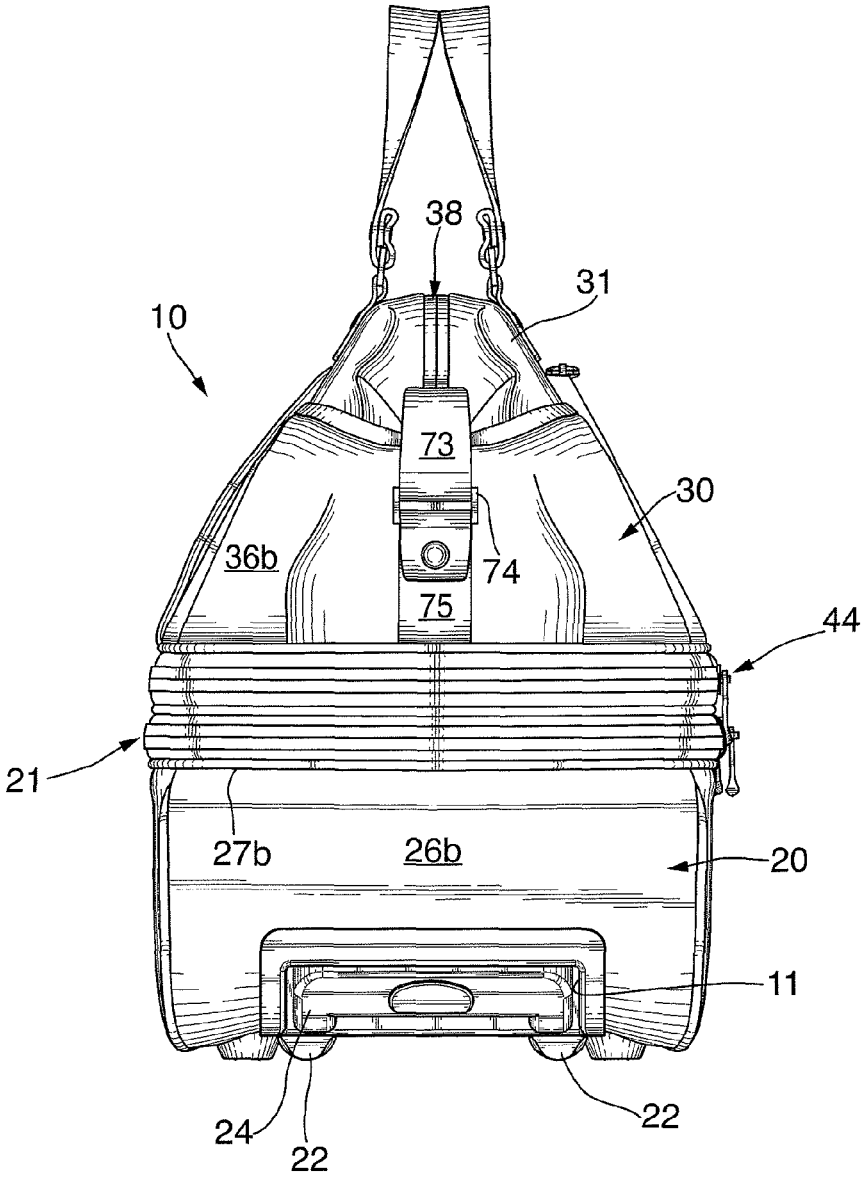
FIG. 4 is a right side elevational view thereof.
Figure 5:
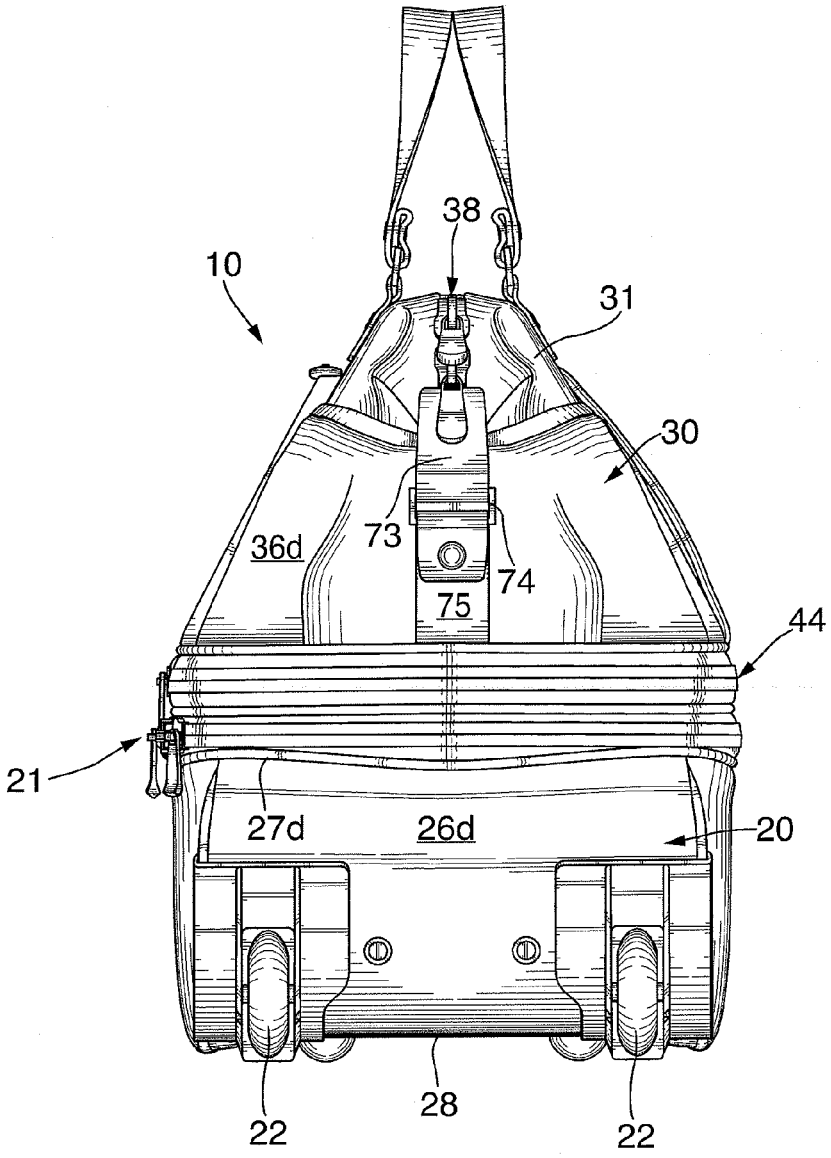
FIG. 5 is a left side elevational view thereof.
Figure 6:
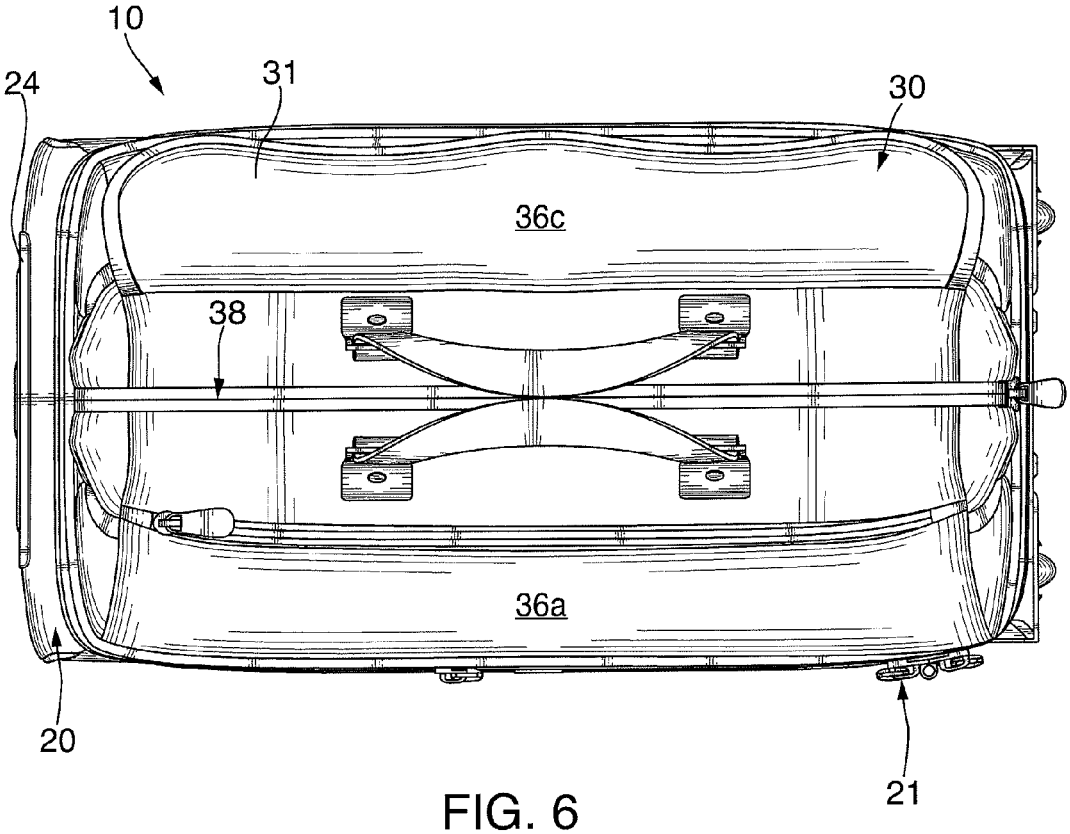
FIG. 6 is a top plan view thereof.

Second luggage 30 also has a pair of handles 70, each coupled to an opposite sidewall 36*a* and 36*c*, respectively, of upper portion 31 of second luggage bag 30. Additionally, an optional shoulder strap (not shown) is removably securable to opposite ends of second luggage bag 30. In particular, two straps 73 are secured to one of side walls 37*b*, 37*d* of second luggage bag 30. Straps 73 each have a metal ring 74 on a free end thereof which is attachable to a shoulder strap. When the shoulder strap is not being utilized, the free ends of straps 73 can be secured to the sides of second luggage bag 30 via two second straps 75 provided on sidewalls 36*b* and 36*d*, having a loop formed therein and a snap fastener. Free ends of second straps 75 are each inserted into a metal ring 74 and each of second straps 75 are looped and connected to one of sidewalls 36*b* and 36*d*. However, it can be appreciated that other means for fastening the shoulder strap can be utilized and the locations thereof can be altered. As shown in FIGS. 1 and 3, the second luggage bag 30 also includes an outer compartment 80 which is accessible via a flap 81.

The preferred dimensions of the luggage 10 in the non-expanded or collapsed configuration, as seen in FIGS. 1-7 are approximately 21⅛" in length, 10" in width, and 15½" in height. In the fully expanded configuration (best seen in FIGS. 9-11) the luggage 10 has dimensions of approximately 21⅛" in length, 10" in width, and 20½" in height. Therefore, it can be appreciated that the luggage 10 gains approximately an additional 5" in height and 1,056¼" cubic inches by the expansion of second luggage bag 30. Of course, it is understood that dimensions can be varied to suit a particular need or desired volume increase or decrease.

The luggage is preferably made of a durable yet pliable fabric, such as, for example, 1680 Ballistic Nylon, and accentuated with faux crocodile patent trim, but can be constructed from other suitable materials. The luggage can appear in different colors, or have unique identifying indicia thereon to visual identify and distinguish the luggage. Other suitable constructions, including the utilization of more than three separate and distinct compartments, along with the associated expandable compartments are possible. Other suitable constructions, including a variation of the size, number, and location of pockets, both inside and outside of the luggage, are possible.

Thus, while particular embodiments of the invention have been described, it is not intended that the invention be limited thereto, as it is intended that the invention be as broad in scope as the prior art will allow and that the specification be read likewise. It will therefore be appreciated by those skilled in the art that other modifications could be made thereto without departing from the spirit and scope of the invention.

What is claimed is:

1. An expandable multi-compartment luggage, comprising:

a first luggage bag having four sidewalls, and a closed bottom which define a first interior compartment therebetween;

a second luggage bag hingeably attached via a first hinge to said first luggage bag and moveable between a first closed position whereby said second luggage bag is connected to said first luggage bag to restrict access to said interior compartment of said first luggage bag, and a second open position to provide access to said interior compartment of said first luggage bag, wherein said second luggage bag has an upper portion and a collapsible lower portion, wherein said upper portion is hingeably attached via a second hinge to said collapsible lower portion, said collapsible lower portion having a closed bottom and four lower sidewalls, each having an upper edge collectively defining an upper rim and said upper portion having four generally upstanding upper sidewalls defining an upper interior compartment therebetween, each of said upper sidewalls having a lower edge collectively defining a lower rim at least a portion of which is releasably coupleable to a portion of said upper rim of said lower portion, wherein said upper portion has an upper rim defining an openable top, and wherein said collapsible lower portion is moveable between a collapsed position to an expanded position, said expanded position defining a lower interior compartment between said closed bottom and four lower sidewalls of said lower portion; and a dividing wall disposed between said upper and lower portions of said second luggage bag, said dividing wall being movable from a closed position dividing said upper interior compartment of said second luggage bag and said lower interior compartment of said second luggage bag and an open position wherein said upper interior compartment of said second luggage bag is in communication with said lower interior compartment of said second luggage bag, wherein said first hinge and said second hinge are disposed on the same side of said luggage, and wherein in said collapsed position, said four lower sidewalls of said lower portion of said second luggage bag are concealed between said dividing wall and said closed bottom of said lower portion of said second luggage bag.

2. The luggage according to claim 1, further comprising:

a first zipper, wherein said four sidewalls of said first luggage bag each have a top edge and said second luggage bag is hingeably attached to said top edge of one of said sidewalls of said first luggage bag and said first zipper extends around said top edges of said other three sidewalls of said first luggage bag.

3. The luggage according to claim 1, further comprising:

a plurality of wheels and a handle attached to said first luggage bag.

4. The luggage according to claim 1, further comprising:

four generally rigid foldable walls which have a size which generally corresponds to the size of said four lower sidewalls of said second luggage bag and wherein said four lower sidewalls each have a lower edge and said foldable walls are each hingeably connected to one of said four lower sidewalls generally adjacent to said lower edge and are pivotably moveable from a flat position wherein said foldable walls overlie said closed bottom of said lower portion and a generally upright position wherein said foldable walls each overlie one of said lower sidewalls.

5. The luggage according to claim 4, wherein:

each of said foldable walls has a hook and loop fastener and each of said lower sidewalls of said second luggage bag has a corresponding hook and loop faster, each of which releasably engages with one of said hook and loop fasteners on said foldable walls, to maintain said foldable walls in said upright position.

6. The luggage according to claim 1, wherein:

said dividing wall has a flap disposed therein and a zipper extending around a portion of the periphery of said flap.

7. The luggage according to claim 1, further comprising:

a second zipper extending around said lower portion of said second luggage bag for maintaining said lower portion in said collapsed position with said four lower sidewalls and said closed bottom of said lower portion concealed between said second zipper.

8. The luggage according to claim 1, further comprising:

a third zipper which extends around said upper edge of three of said lower sidewalls of said lower portion of said second luggage bag.

9. The luggage according to claim 1, further comprising:

a pair of handles, each coupled to an opposite sidewall of said upper portion of said second luggage bag.

* * * * *